United States Patent [19]

Wood et al.

[11] Patent Number: 4,954,756

[45] Date of Patent: Sep. 4, 1990

[54] METHOD AND APPARATUS FOR CHANGING THE EMISSION CHARACTERISTICS OF AN ELECTRODELESS LAMP

[75] Inventors: Charles H. Wood, Rockville, Md.; David Mosher, Falls Church, Va.

[73] Assignee: Fusion Systems Corporation, Rockville, Md.

[21] Appl. No.: 256,227

[22] Filed: Oct. 11, 1988

Related U.S. Application Data

[63] Continuation of Ser. No. 73,670, Jul. 15, 1987, abandoned.

[51] Int. Cl.[5] ..... H01J 7/46

[52] U.S. Cl. ..... 315/39; 313/248; 313/112; 313/111.21; 313/44

[58] Field of Search ..... 315/248, 112, 267, 447, 315/111.21, 39, 344, 117, 118; 313/35, 15, 44; 362/386, 373

[56] References Cited

U.S. PATENT DOCUMENTS

| | | | |
|---|---|---|---|
| 3,978,361 | 8/1976 | Hiramoto | 313/44 |
| 3,989,983 | 11/1976 | Uchino et al. | 313/44 |
| 4,485,332 | 11/1984 | Ury et al. | 315/112 |
| 4,501,993 | 2/1985 | Mueller et al. | 315/248 |
| 4,507,587 | 3/1985 | Wood et al. | 315/248 |

*Primary Examiner*—Leo H. Boudreau
*Assistant Examiner*—Michael Razavi
*Attorney, Agent, or Firm*—Pollock, Vande Sande & Priddy

[57] ABSTRACT

A method of modifying light and heat emission patterns from an electrodeless lamp which includes an envelope containing a plasma-forming medium and a source of electromagnetic energy coupled to the plasma-forming medium. The method consists of rotating the envelope at a rate fast enough to modify surface heating and the distribution of radiating plasma along lines of constant longitude on the envelope.

7 Claims, 2 Drawing Sheets

METHOD AND APPARATUS FOR CHANGING THE EMISSION CHARACTERISTICS OF AN ELECTRODELESS LAMP

This application is a Continuation of application Ser. No. 073,670, filed July 15, 1987 and now abandoned.

This invention relates to electrodeless lamps which are energized by microwaves, and more particularly to methods of modifying the light and heat emission patterns from electrodeless lamps.

BACKGROUND OF THE INVENTION

The electrodeless lamps with which the present invention is concerned generally comprise a microwave cavity within which is mounted a lamp envelope which contains a plasma-forming medium. This medium is energized by microwaves, R.F., or other electromagnetic energy, thereby creating a plasma which emits radiation in the ultraviolet, visible, or infrared portion of the spectrum.

In a typical electrodeless lamp the electrical energy is coupled to the cavity and to the lamp with a constant electric field geometric orientation which results in hot zones within the lamp envelope volume, and therefore non-uniformity in the radiation emitted from various portions of the envelope and in wall temperatures. Non-uniform wall temperatures unduly restrict the power which can be applied to the lamp, and non-uniform light emission is undesirable for some applications.

The distribution of light intensity in an electrodeless, microwave driven lamp is a complex function of many variables including the electrical power, the plasma-forming constituents in the envelope, and the geometries of the microwave power feed, the microwave resonant cavity, and the bulb envelope. The non-uniform distribution of light can be compensated for in the design of reflectors in some instances, but it is not always feasible to solve the problem of non-uniform light emission in this manner, and improved methods of increasing the uniformity of the intensity of light which is emitted from an electrodeless lamp are desirable.

Electrodeless lamps transfer a great amount of heat energy to the envelope surface. Electrical power which is coupled to the plasma-forming medium and the plasma by microwaves and which is not radiated away to the environment is absorbed by the envelope through conduction, convection, and radiation. This thermal loading of the envelope, which as noted above is typically non-uniform, requires that the envelope be cooled to protect it from temperatures which would soften or even melt it.

As noted above, non-uniform wall temperatures are undesirable, and U.S. Pat. No. 4,485,332 addresses this aspect of the cooling problem and provides a cooling method in which a stream or streams of a cooling gas are directed against the surface, including the hot spots, of an envelope which is being rotated. A relatively low rotation rate, such as for example, a rotation rate of 300 RPM was able to produce substantially uniform temperatures at the points on the surface of the envelope within a plane which was perpendicular to the axis of rotation, i.e., along lines of constant latitude. Slow rotation rates were successful in making the temperature distribution symmetrical in azimuth around the rotation axis because the heat capacity of the envelope resulted in cooling times in the range of seconds, i.e., times which are greater than the rotation period. However, these low rotation rates did not eliminate the non-uniformities of temperatures on the surface of the envelope along lines of constant longitude, that is, along great circles which passes through the poles.

U.S. patent application Ser. No. 674,631 filed Nov. 26, 1984 by Ury, et al. for "Method and Apparatus for Cooling Electrodeless Lamps" also addresses the cooling problem and describes a method of cooling electrodeless lamps by directing a stream of cooling gas at the lamp envelope and providing relative rotation between the lamp envelope and the stream of cooling gas. The method of relative rotation described therein included rotating the streams of cooling gas about the envelope. Japanese Application No. 229730/83 which corresponds to U.S. patent application Ser. No. 674,631 has been laid open.

SUMMARY OF THE INVENTION

It is accordingly one object of this invention to provide an improved method and apparatus for increasing the uniformity of temperatures on the surface of an envelope in an electrodeless lamp.

It is still another object of this invention to provide a method of modifying the spectrum which is emitted from selected regions of the envelope in an electrodeless lamp.

It is yet another object of this invention to provide a method of changing the emission characteristics of an electrodeless lamp whereby the light intensity at the equatorial regions is substantially the same as the light intensity at the polar regions.

It is still another object to increase the power level at which electrodeless lamps may be operated.

It has been discovered that at sufficiently high envelope rotation rates heat convection to the envelope is modified by the centrifugal force in such a way that the equatorial region of the envelope is reduced in temperature. When the axis of the electric field is about 90° from the axis of rotation, hot spots formed in the equatorial regions are reduced by this action at high rotation rates. The intensity of light emitted from the equatorial region is also reduced.

In accordance with the invention the foregoing objects have been achieved by rotating an envelope which contains a plasma-forming medium and is energized by microwaves. The rotation is carried out at a rate which is great enough for the centrifugal forces created thereby to reduce convective heating of the equatorial region of the envelope. The rotation is at a rate which is significantly greater than that which will produce a substantially uniform temperature along lines of constant latitude on the envelope, while leaving non-uniformities along lines of constant longitude.

The terms "polar region" or "polar area" refer to those areas at the surface of the envelope which are at or near the crossing point of the axis of rotation.

The terms "equatorial region" or "equatorial area" refers to those areas at the surface of the envelope which lie on or near the great circle of zero latitude.

DETAILED DESCRIPTION OF THE INVENTION

Figure 1:
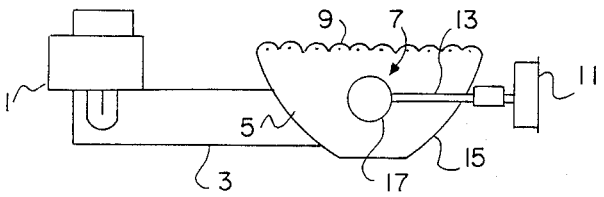
FIG. 1 is a schematic illustration of an electrodeless lamp which may be used to carry out the method of this invention.

Referring to FIG. 1, magnetron 1 feeds microwave power through waveguide 3 and slot 5 into microwave resonant cavity 7. Cavity 7 is defined by reflector walls 15 and screen 9. Envelope 17, which contains mercury as a constituent of a plasma-forming medium, is mounted on stem 13 which is rotated by motor 11.

Figure 2:
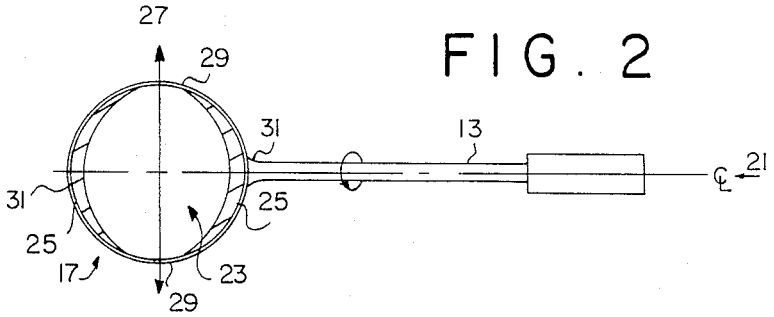
FIG. 2 is a schematic drawing of an embodiment of an envelope for an electrodeless lamp which illustrates the distribution of the radiating material about the inner surface of the envelope which is being rotated slowly.

FIG. 2 depicts the distribution of light-emitting mercury vapor 25 when the envelope 17 is rotated at a relatively low rate.

As shown in FIG. 2, the rotation axis 21 of envelope 17 is perpendicular to the axis 27 of the electric field. The convective forces of the electric field act on the plasma 23 within the envelope 17 to produce a relatively thick layer of cool mercury vapor 25 in the polar regions 31, and a thin layer in the equatorial regions 29. Surface temperature is greatest in the equatorial region.

Figure 3:
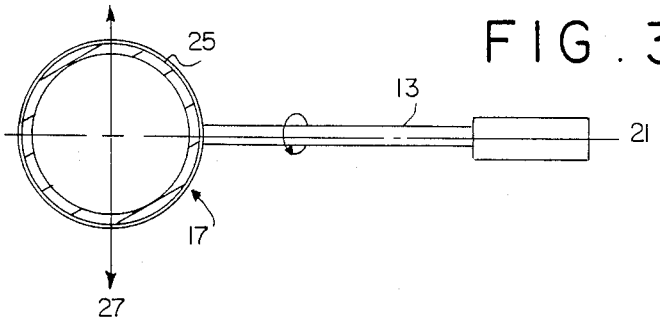
FIG. 3 is a schematic drawing of an embodiment of an envelope for an electrodeless lamp which illustrates the distribution of a plasma-forming medium about the inner surface of an envelope which is being rotated in accordance with the present invention.

FIG. 3 shows the effect on the distribution of cool mercury vapor of rotating the envelope 17 at a rate which is significantly higher than the rotation rate of the envelope of FIG. 2. The cool mercury vapor 25 is shown as being distributed substantially uniformly about the inner surface of envelope 17. Under these conditions, the temperature in the equatorial region is reduced to levels close to those in other surface regions. A more uniform intensity of light which is emitted from various regions of the envelope also results from the increased rotation rate.

Figure 4:
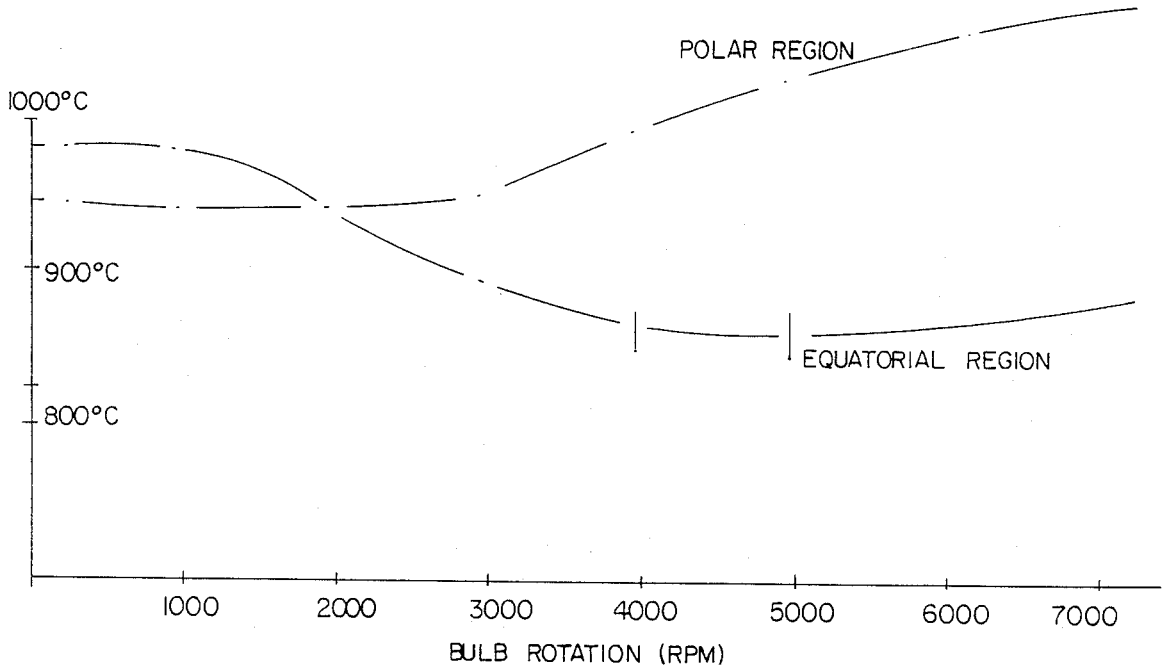
FIG. 4 is a graph showing the effect of rotation rate upon the temperatures at the polar regions and at the equatorial regions.

FIG. 4 shows the results of tests run on an apparatus depicted in FIG. 1 to determine the relationship between surface temperature and rotation rate. The apparatus consisted of a spherical envelope having an inside diameter of 28 mm and a fill consisting of argon, mercury, and a metal halide. The lamp coupled 1.4 kilowatts of microwave power at 2.45 GHz. At rotation rates between about 100 and 1000 RPM there was no significant change in the distribution of cool mercury vapor within the envelope. At speeds of about 2000 RPM the cool mercury vapor became substantially evenly distributed about the inner surface of the envelope. As shown in FIG. 4, the temperature at the area around the polar axis remained nearly constant until a rate between 2000 and 3000 RPM was reached, at which rate the temperature started to increase. The temperature at the equatorial regions remained constant until a rotation rate between 1000 and 2000 RPM was reached at which rate the temperature began to decrease. At about 2000 RPM the temperature was substantially the same at the equatorial regions as at the polar regions.

As can be seen from FIG. 4, the rotation rate can be selected to achieve highly uniform temperatures at the envelope surface. Although the changes in uniformity of surface temperature do not necessarily produce equivalent changes in uniformity of emission of light, for the system shown in FIG. 1 a rotation rate of about 2000 RPM also produces uniformity of light emission.

As noted above, changes in rotation rate also can produce changes in spectrum emitted from different portions of the surface of the bulb. For example, electrodeless lamps designed for visible applications may be filled with a number of metal halides each of which contributes to different parts of the visible spectrum. In operation, some types of metal halides may separate from other types. The result is different color emitted from one area of the lamp compared to another.

By selecting the rotation rate at which the additive separation or color separation is minimized, the lamp performance is significantly improved for applications requiring high quality color imaging or projection.

The optimum rotation rate, i.e., the rotation rate which provides the desired heat, light and color distribution, will typically be different with different lamp designs. For example, the optimum rotation rate will decrease with an increase in the diameter of the envelope. Other factors which may influence the optimum rotation rate are the microwave cavity dimensions, the microwave frequency, the operating power level, the constituents of the plasma-forming medium, and the orientation of the rotation axis with respect to the axis of the electric field. Although the distribution of heat, light intensity, and color is a complex function of many variables, the optimum rotation rate can readily be determined experimentally by rotating the envelope under consideration and measuring the temperatures, light intensities and spectrum at various rates.

Rotation rates greater than about 600 RPM are typically necessary to have any measurable effect on surface heating, light or color distribution about an envelope. Rotation rates in the range of 1500 to 2500 RPM will normally be required to achieve uniformity in these emission properties for envelopes having diameters from 0.75 inch to 1.5 inch.

If the axis of rotation is parallel to or coincident with the axis of the electric field, rotating the envelope will increase the temperature differences between the polar and equatorial regions and increase the non-uniformity in light emission. Consequently, it is essential in practicing this invention that the axis of rotation be properly oriented to the axis of the electric field. To increase uniformity between polar and equitorial regions, the angle between the two axes should be greater than 30° and preferably close to 90°. To increase differences between the two regions, the two axes should be close to parallel.

The envelope as shown in the drawings is spherical; however envelopes having shapes other then spherical may be used in practicing this invention, and other variations falling within the scope of the invention may occur to those skilled in the art, and the invention is limited only by the claims appended hereto and equivalents.

We claim:

1. A method of changing the emission properties of an electrodeless lamp, said lamp comprising an envelope which contains a plasma-forming medium and means for coupling electromagnetic energy to the medium within said envelope to generate an electric field and form a light-emitting plasma, said method comprising establishing an axis of rotation which is at an angle of between about 30° and 90° with respect to the electric field, and rotating said envelope about said axis at a rate of at least about 1000 rpm, said rate being great enough for the centrifugal forces produced thereby to modify surface heating and the distribution of plasma-forming medium about the inner surface of said envelope and concomitantly change the emission properties of the electrodeless lamp, said rotation rate being significantly greater than that which is required to produce a substantially uniform temperature about lines of constant latitude of said envelope while leaving non-uniformities along lines of constant longitude.

2. The method according to claim 1 wherein the rotation is at a rate which is at least about 1500 RPM.

3. The method according to claim 1 wherein the envelope is a sphere having a diameter from about 0.75 to about 1.5 inches in diameter and the rotation rate is from about 1500 to about 2500 RPM.

4. A method of changing the emission properties of an electrodeless lamp, wherein said lamp includes an envelope which contains a plasma-forming medium and means for coupling electromagnetic energy to the medium within said envelope to generate an electric field and form a light-emitting plasma, said method comprising, establishing an axis of rotation which is about perpendicular to the direction of the electric field, and rotating said envelope about an axis at a rotation rate of at least about 1000 revolutions per minute, said rate being great enough for the centrifugal forces produced thereby to modify surface heating and the distribution of plasma-forming medium about the inner surface of said envelope and concomitantly change the emission properties of the electrodeless lamp, said rotation rate being significantly greater than that which is required to produce a substantially uniform temperature about lines of constant latitude of said envelope while leaving non-uniformities along lines of constant longitude.

5. In an electrodeless lamp, a method of changing the temperature distribution around the surface of the lamp envelope, wherein said envelope contains a plasma forming medium and said lamp includes means for coupling microwave energy to said medium within said envelope to generate an electric field and form a light-emitting plasma, said method comprising, establishing an axis of rotation which is at an angle of between about 30 degrees and 90 degrees to the direction of the electric field, and rotating said envelope about said axis at a rotation rate of at least about 1000 revolutions per minute, wherein said rate is great enough for the centrifugal forces produced thereby to modify the surface heating of the envelope and the temperature distribution thereabout, said rotation rate being significantly greater than that which is required to produce a substantially uniform temperature about lines of constant latitude of said envelope while leaving non-uniformities along lines of constant longitude.

6. The method of claim 4 wherein the rotation is at a rate which substantially equalizes the temperature distribution about the lamp envelope.

7. The method of claims 1, 4, or 5 further comprising the step of directing at least one stream of cooling gas at the rotating envelope.

* * * * *